United States Patent [19]

Wolfe

[11] 4,010,430

[45] Mar. 1, 1977

[54] LOW LOSS, BROADBAND SWITCHABLE MICROWAVE STEP ATTENUATOR

[75] Inventor: Allen Robert Wolfe, Sauquoit, N.Y.

[73] Assignee: General Electric Company, Utica, N.Y.

[22] Filed: Oct. 17, 1975

[21] Appl. No.: 622,923

[52] U.S. Cl. ..... 333/81 A; 333/84 M

[51] Int. Cl.[2] ..... H01P 1/22

[58] Field of Search ..... 333/81 R, 81 A

[56] References Cited

UNITED STATES PATENTS

| | | | |
|---|---|---|---|
| 3,518,585 | 6/1970 | Wilcox | 333/81 R |
| 3,529,266 | 9/1970 | King | 333/81 A |
| 3,774,123 | 11/1973 | Hume | 333/81 A X |
| 3,775,708 | 11/1973 | Sly | 333/81 A |

*Primary Examiner*—Paul L. Gensler

[57] ABSTRACT

A printed rf circuit switchable step attenuator for frequencies in the Gigahertz range employs PIN diodes for switching a pi network in and out of a transmission line. The A.C. grounded terminations of the pi network are constructed through the use of low impedance, open end stubs, eliminating the need for plated over-edge ground connections. D.C. bias potential for controlling the switching diodes is coupled to the rf portion of the circuit by means including high impedance grounded stub conductors connected to the transmission line. To achieve broadband operation the admittance of the stub conductors is tuned out by configuring the transmission line as a series of differing line length and impedance sections which are arranged symmetrically with respect to the point of intersection between the grounded stub conductors and the line.

7 Claims, 7 Drawing Figures

LOW LOSS, BROADBAND SWITCHABLE MICROWAVE STEP ATTENUATOR

BACKGROUND OF THE INVENTION

Heretofore, a printed circuit rf switchable step attenuator for use in the Gigahertz range has been constructed by using a pair of single pole, double throw switches arranged to allow selective switching of the signal path between a straight-through conductor and an attenuator network such as a T-pad or a pi-pad. High performance has been difficult to attain with this type of circuit arrangement, particularly where broadband response is required, for essentially two reasons. First, proper ground connections for the shunt resistor or resistors in the attenuation network have been difficult to achieve because the usual grounding means (plated over-edges and plated through-holes) have a large amount of parasitic series inductance associated with them at microwave frequencies. Thus, placement of the shunt resistor with respect to the ground terminal is very critical. Second, in order to couple the necessary D.C. bias potential into the rf circuit for switching purposes the use of high impedance "flying lead" inductors is necessary. Both these past requirements have made construction of broadband attenuators very expensive and difficult to manufacture with a high degree of repeatability.

Additionally, the use of a pair of single pole, double throw switches requires the use of at least two diodes in series with the signal path of all times. Since series diodes are the main cause of insertion loss in a circuit of this type, the use of multiple series diodes substantially increases the insertion loss and this is extremely undesirable when operating the circuit in its low attenuation state.

OBJECTS AND SUMMARY OF THE INVENTION

It is accordingly an object of the present invention to provide a switchable microwave step attenuator which minimizes insertion loss when operating in the low attenuation state, which is capable of operation over a multi-octave frequency range and which is readily manufacturable through inexpensive, highly reproducible printed circuit production techniques.

It is another object of the invention to provide a printed circuit rf switchable step attenuator for use in the Gigahertz frequency range which does not rely on flying leads or wire-wound or laser-trimmed helical high impedance inductors and further which does not employ plated over-edges or plated through-holes at critical grounding points.

In accordance with the present invention a switchable microwave step attenuator is fabricated through common rf printed circuit (microstrip and stripline) techniques and employs a circuit having a central transmission line incorporating a diode-shunted attenuation resistor and which further incorporates a pair of diode switchable A.C. grounded open end stubs for providing low loss, broadband operation. D.C. bias potential for switching the diodes is coupled into the rf circuit through the use of high impedance grounded stub conductors connected to the transmission line. The transmission line, at the point where each stub conductor intersects, is configured as a series of segments having different line lengths and impedance characteristics which are selected so as to tune out the admittance of the stub conductor over a broad range of frequencies, whereby broadband operation is obtained. To further enhance the bandwidth characteristics of the circuit, the A.C. grounded open end stubs are constructed in a low impedance alternating resistor-conductor configuration wherein the resistor and conductor parameters are selected to provide essentially a constant impedance over the frequency band of interest.

These and other objects, features and advantages will be made apparent by the following detailed description of a preferred embodiment of the invention, the description being supplemented by drawings as follows:

DETAILED DESCRIPTION OF EMBODIMENT

Figure 1:
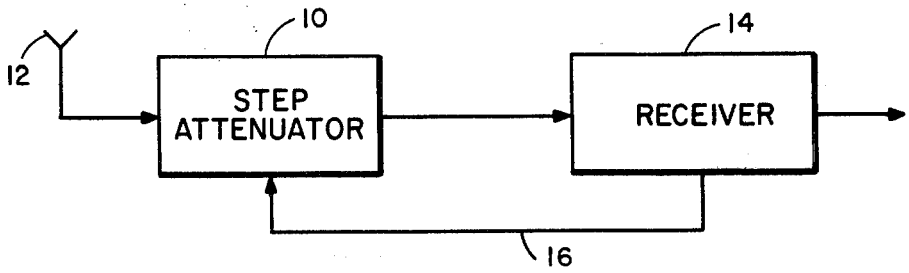
FIG. 1 is a block diagram illustrating one use of the step attenuator of the invention as part of a microwave receiving system.

Referring to FIG. 1, a step attenuator 10 is shown located in the line between an antenna 12 and receiver 14. The receiver system may be responsive, for example, to radiation in a frequency range between 2 and 8 Gigahertz. The attenuator 10 operates to increase the dynamic range of receiver 14 by limiting the strength of the received signal in situations when receiver 14 would be saturated by the unattenuated signal. A control signal is applied to the attenuator on a line 16 from the receiver in order to automatically control the attenuator level in accordance with the signal strength as detected at the receiver.

Figure 2A:
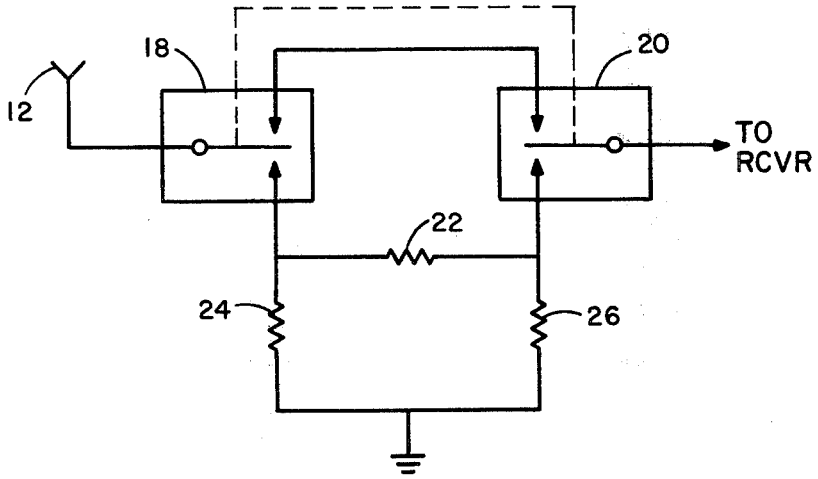
FIG 2a PRIOR ART
FIGS. 2*a* and 2*b* are schematic diagrams depicting two configurations of prior art SPDT-switched attenuator circuits.

As shown in FIG. 2*a*, the prior art has provided a switchable attenuator by coupling a pair of SPDT (single pole double throw) switches in the signal channel from the antenna such that alternative transmission paths of different impedance are provided. The control input from the receiver operates switches 18 and 20 in tandem such that when the switches are in their upper position the level of attenuation approaches 0 db. However, when the control places switches 18 and 20 in their lower position the signal is coupled through a path having an attenuation resistance 22 for providing signal reduction. Resistances 24 and 26 are coupled to either side of resistance 22 to provide the required impedance matching function to prevent undue reflections and concomitant signal loss. Resistors 22, 24 and 26 together form a network known in the microwave art as a pi-pad or pi network. The circuit of FIG. 2*a* provides a single level of attenuation.

Figure 2B:
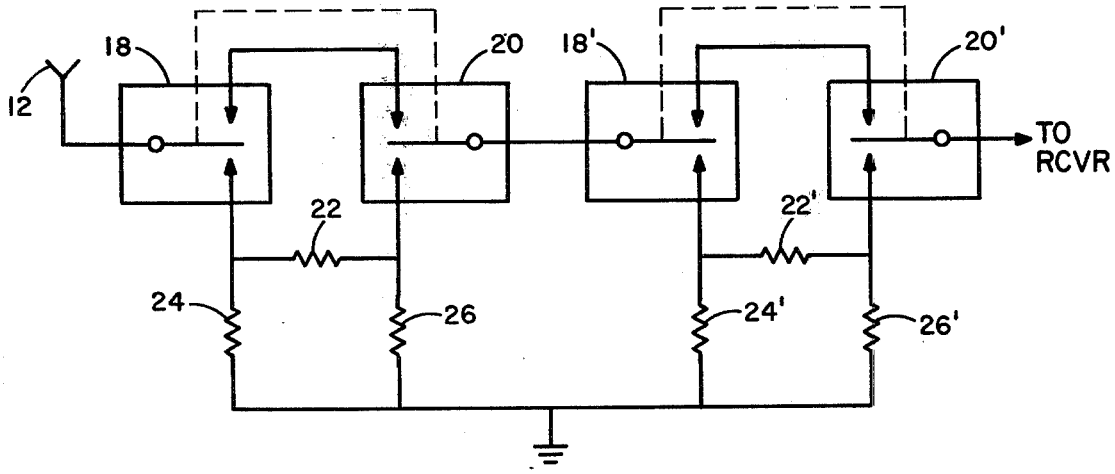
FIG 2b PRIOR ART

The circuit shown in FIG. 2*b* provides two discrete levels of attenuation and includes two of the FIG. 2*a* circuits cascaded in series. Thus, when SPDT switches 18, 20, 18′ and 20′ are all placed in the upper position by the control function from the receiver, attenuation approaching 0 db is provided since the signal is coupled from the antenna to the receiver through a pair of straight-through signal paths. To provide a first level of attenuation one pair of the switches 18–20 or 18′–20′ is switched to the lower position while the other pair is left in the upper position. The signal path thus includes one straight-through section and one pi-pad attenuation network. When both pairs of switches are moved to the lower position the signal is transmitted to the receiver through two pi-pad attenuation networks and a second, higher level of attenuation is provided.

One problem experienced with these types of networks stems from the fact that when 0 db attenuation is desired a minimum amount of insertion loss should be imposed upon the signal by the network. It should be noted from FIGS. 2*a* and 2*b* that when the switches are in their upper position the signal is coupled to the receiver through a conduction path of presumably low impedance. However, the signal also must pass through both of the SPDT switches and some signal loss is experienced in each switch. When the circuit is constructed in accordance with typical printed rf circuit techniques, switching diodes are employed to implement the function of the SPDT switches and thus the switches place a minimum of two diodes in series with the signal path at all times. Since series diodes are a source of considerable insertion loss in this type of circuit it is desirable to reduce the number of series diodes to a minimum. It will be noted in looking at FIG. 2*b* that since four switches are used, four series diodes are imposed in the signal path at all times.

A second problem in the construction of these types of circuits in printed circuit form for use in high frequency (e.g., Gigahertz) applications, has been the provision of suitable ground terminations for the shunt resistors such as resistors 24 and 26 of FIG. 2*a*. Typically, plated over-edges and plated through-holes have been employed. However, such termination structures have a large amount of parasitic series inductance associated with them at high frequencies, making the placement of the shunt resistor element with respect to the ground connection very critical. This increases the cost of fabricating the circuits. Another construction difficulty that has been encountered relates to the provision of suitable high impedance inductor elements for coupling D.C. bias voltages to the rf portion of the circuit to operate the switching diodes. A typical coupling element that has been used is the so-called flying lead which is essentially a quarter-wavelength stub supported above the surface of the substrate to provide high impedance. Flying leads are particularly difficult to construct on a consistent basis. Expensive final hand tuning of the leads is required to secure proper performance.

Figure 3:
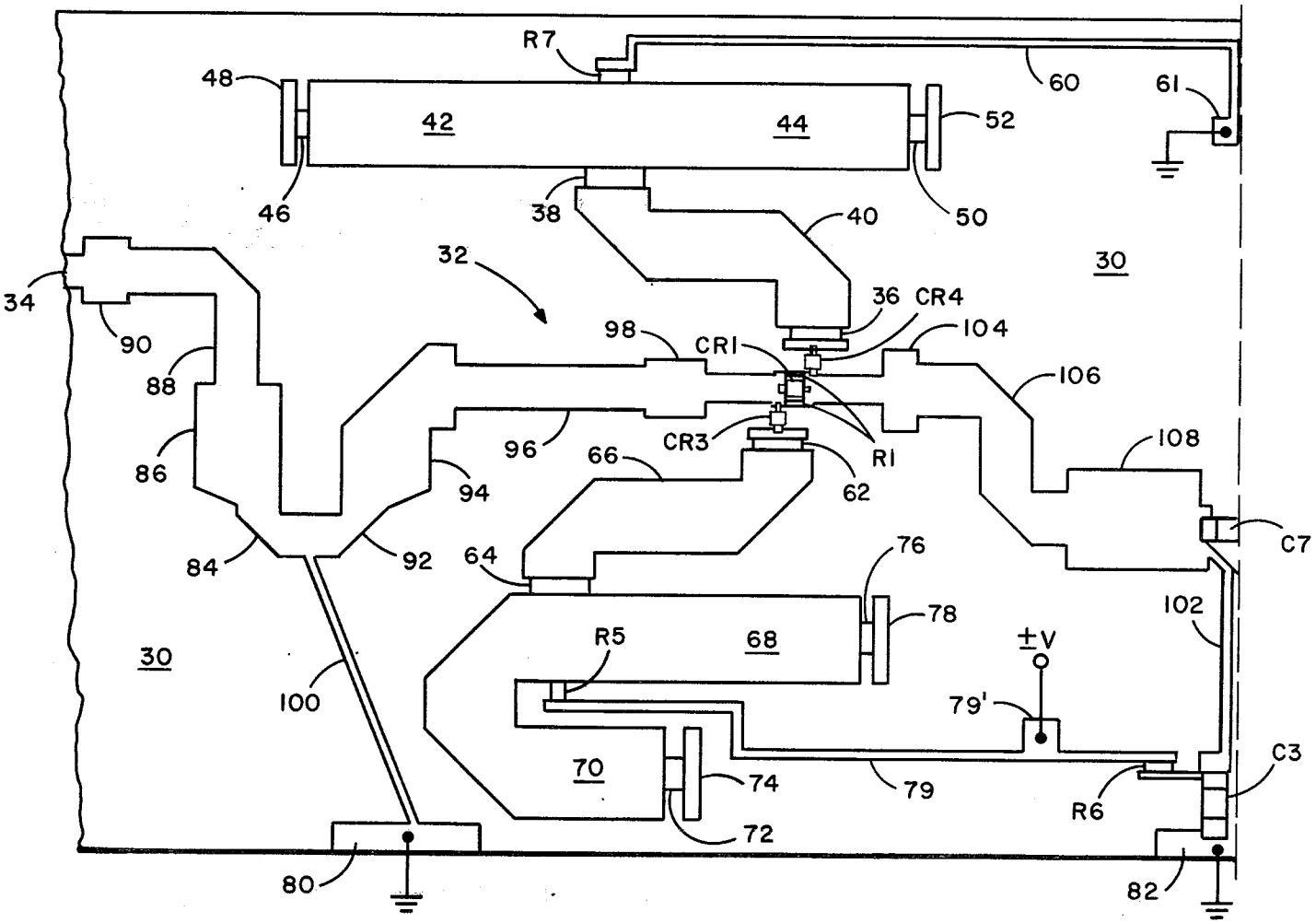
FIG. 3 is a plan view of a preferred form of microstrip step attenuator in accordance with the present invention, the right-hand portion of the symmetrical circuit configuration being omitted for clarity.
Figure 6:
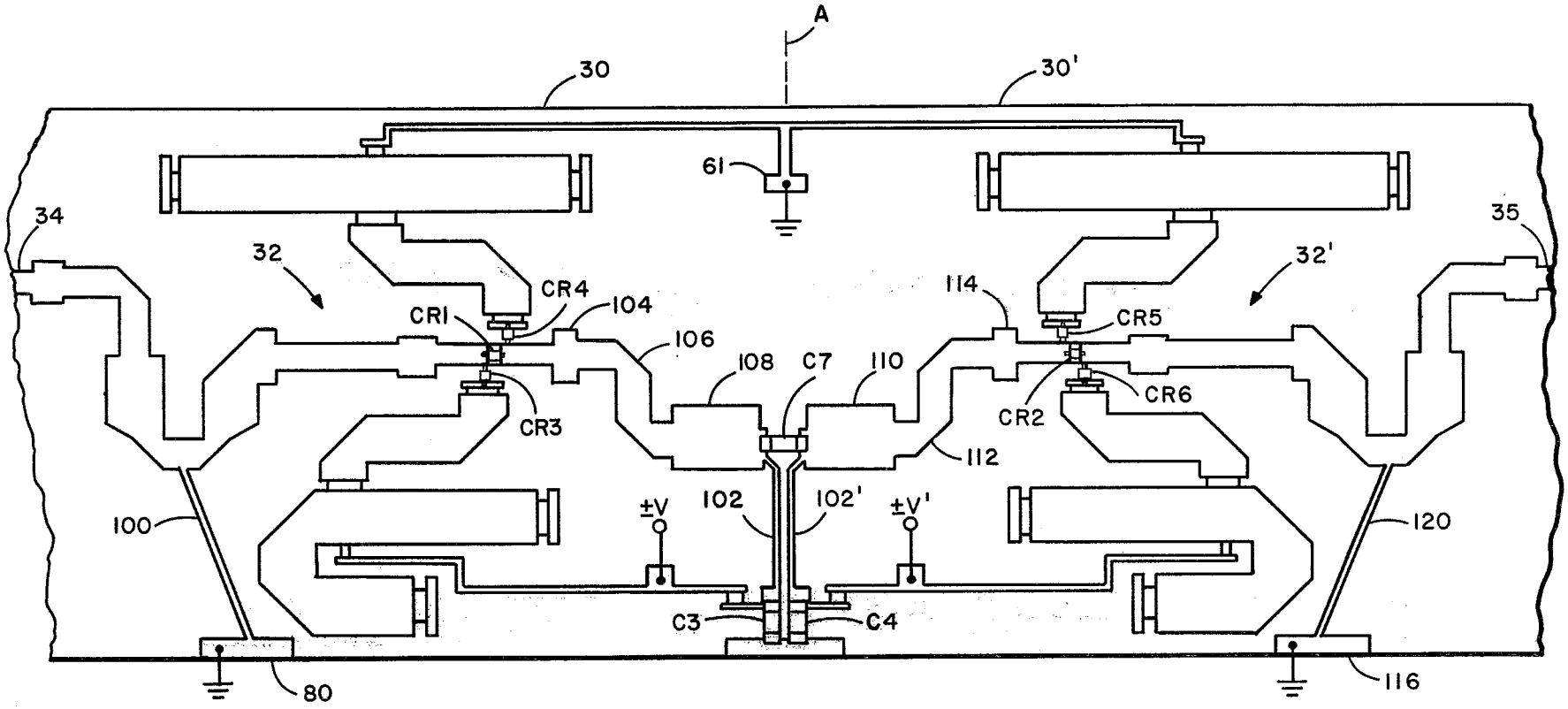
FIG. 6 is a plan view of the full circuit configuration of a microstrip step attenuator constructed in accordance with the invention.

Referring now to FIG. 3, a preferred embodiment of the attenuator circuit in accordance with the present invention is described. FIG. 3 is a magnified representation of the upper surface of a microstrip circuit substrate showing the circuit elements of the first stage of a two stage attenuator in accordance with the invention. The second attenuation stage is a mirror image of the first such that the circuit configuration for the total circuit is exactly symmetrical about the dashed line shown at the right of FIG. 3. The total circuit configuration is shown in FIG. 6.

In FIG. 3 the attenuator circuit is shown distributed on the upper surface of an insulative substrate 30 which may, for example, comprise a 25 mil aluminum oxide chip. The received signal from the antenna is coupled to end 34 of microstrip transmission line 32 running generally across the center of the substrate.

In the approximate center of transmission line 32 a PIN diode CR1 is connected in shunt with a pair of resistive elements R1, together comprising an attenuation resistance. A capacitive element C7 connects the right hand end of the transmission line to the transmission line segment associated with the second attenuation stage (see FIG. 6). A pair of A.C. grounded resistive termination elements are connected to the transmission line on either side of the resistance R1. The A.C. grounded resistive termination means include a pair of low impedance open end stub elements having alternating resistor-conductor sections. The lower stub includes conductors 66, 68 and 70 and resistors 62 and 64. Conductors 68 and 70 can be considered as two conductors connected in parallel to resistor 64 and are the equivalent of one large conductor of very low impedance. The upper open end stub is identical to the lower stub and includes conductor elements 40, 42 and 44 together with resistors 36 and 38. Conductors 40, 66 and 70 have been folded in a conventional manner to conserve on circuit space. A PIN diode CR3 connects the lower stub network to transmission line 32. Similarly a PIN diode CR4 connects the upper stub to the transmission line.

Together, resistors R1 and the two open end stubs operate as a pi-pad attenuation network. A pair of small capacitive elements 48 and 52 are connected through resistors 46 and 50 to the ends of upper stub conductor elements 42 and 44, respectively, and are configured so as to eliminate unpredictable narrow-band resonance in the stub. In a similar manner a pair of capacitive elements 74 and 78 are connected by resistive elements 72 and 76 to the outer ends of conductor elements 70 and 68, respectively, on the lower stub.

In order to permit the coupling of a D.C. bias potential into the above described microstrip attenuation network, a pair of grounded high impedance stubs 100 and 102 are coupled to the transmission line 32. In addition, a conductor 60 provides a D.C. conduction path from D.C. ground point 61 to an A.C. ground point on the upper open end stub configuration. Conductor 60 is connected to the stub through a resistive element R7 at the point where stub conductors 42 and 44 join. Also, a D.C. conductor 79 is similarly connected to the lower open end stub through resistive element R5 and is also connected to the high impedance grounded stub 102 through resistive element R6. Stub conductors 100 and 102 are connected to ground through D.C. grounded plated over-edged segments 80 and 82, respectively. The over-edge conductor 82 is connected to stub conductor 102 by capacitive element C3 which isolates the stub from D.C. ground.

Control of the switching diodes CR1, CR3 and CR4 is effected by a two-level switchable D.C. bias potential ±V which is coupled to conductor 79′. This bias potential is coupled to the anode of diode CR3 through conductor 79 and the open end stub 66, 68, 70. Likewise, the bias potential is connected to the cathode of diode CR1 and the anode of diode CR4 through conductor 79, high impedance stub 102 and segments 104, 106 and 108 of transmission line 32. D.C. ground is coupled to the cathode of CR3 and the anode of CR1 via high impedance stub 100 and transmission line 32. D.C.

ground is connected to the cathode of diode CR4 via conductor 60 and open end stub 40, 42, 44.

Figure 5:
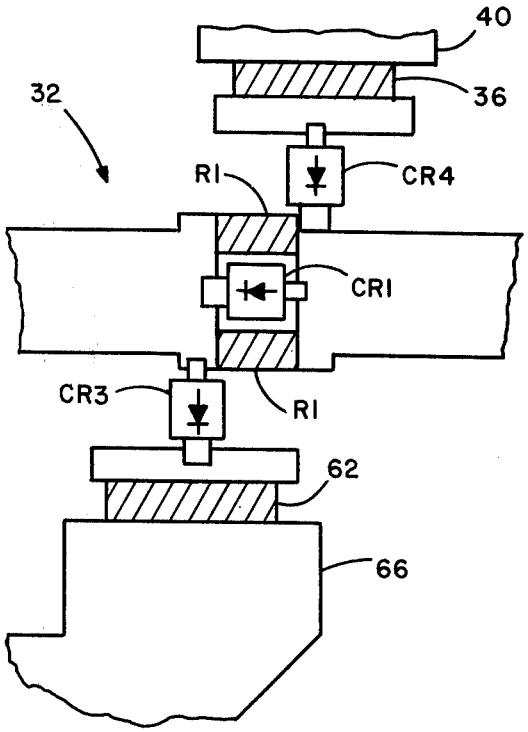
FIG. 5 is an enlarged plan view showing the center portion of the circuit configuration of FIG. 3, illustrating the arrangement of switching diodes in greater detail.

FIG. 5 is an enlarged view of the center section of the attenuation network shown in FIG. 3 and depicts the switching diodes and their interconnection to the rf circuit elements in greater detail. It should be noted that resistive element R1 is split into two parallel sections and that switching diode CR1 is positioned between the resitive sections and connects the two sections of transmission line 32 along the longitudinal center line thereof.

FIG. 6 illustrates the full microstrip circuit configuration. Note that the right hand half of the circuit is exactly symmetrical to the left hand half about dashed line A. The insulative substrate 30' which contains the second stage of the circuit is a continuation of substrate member 30. It is noted that the switching diodes CR2, CR5 and CR6 on the second stage are controlled independently of the first stage diodes by a second two-level D.C. bias potential ±V'. D.C. isolation is provided between voltage sources V and V' by splitting the high impedance grounded stub 102 into two sections, 102 and 102' which appear to the rf energy as a single grounded stub conductor. However, through the use of capacitive elements C3, C4 and C7 D.C. isolation is achieved. It is further noted that switching diodes CR4 and CR5 are provided with a common D.C. ground connection through center conductor 61.

Figure 4:
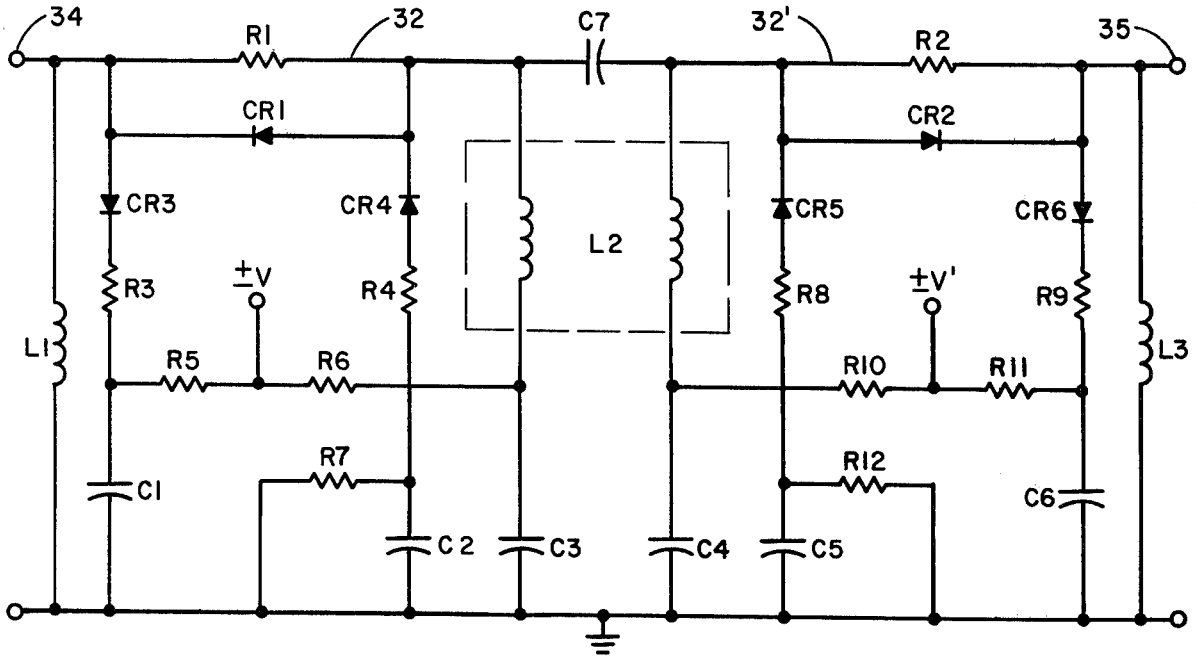
FIG. 4 is a schematic circuit diagram illustrating the equivalent circuit for the step attenuator of FIG. 3.

FIG. 4 schematically represents the two stage attenuation network of FIG. 6. The microwave input signal from the receiving antenna is applied to input terminal 34 and is coupled through to output terminal 35 by the transmission line sections 32 and 32' corresponding to the microstrip conductors 32 and 32' of FIGS. 3 and 6. Inductor element L1 corresponds to the high impedance stub 100 and its adjacent section of transmission line 32 illustrated in FIGS. 3 and 6. The inductor element L2 shown in FIG. 4 as two separate inductors within a dashed rectangle corresponds to the split high impedance stub 102–102' shown in FIG. 6. These elements are shown within the dashed rectangle of FIG. 6 since they appear as a single high impedance inductance to the rf portion of the signal but, as previously explained, to the D.C. control signal they appear as separate, isolated conductors.

Inductor L3 corresponds to the high impedance stub 120 (FIG. 6) together with the sections of transmission line 32' adjacent to it. Terminating resistor R3, which is coupled to ground through capacitor C1, corresponds to the open end stub 66, 68, 70 shown in FIG. 3 while the terminating resistor R4, which is capacitively coupled to ground through capacitor C2 (FIG. 4), corresponds to the open end stub 40, 42, 44 of FIG. 3. Similarly, termination resistor R8 and capacitor C5 of FIG. 4 correspond to the upper open end stub element shown in the second stage circuit of FIG. 6 while the terminating resistor R9 and capacitor C6 of FIG. 4 correspond to the lower open end stub of the second attenuation stage in FIG. 6.

In operation, the attenuation network provides essentially 0 db attenuation to the input signal when both D.C. bias inputs V and V' are in their positive states. This is because in that situation both shunting diodes CR1 and CR2 are forward biased and all four termination diodes CR3, CR4, CR5 and CR6 are reversed biased. CR1 is biased at its cathode by +V acting through R6 and the left branch of L2. Similarly, the cathode of CR2 is biased by +V' acting through resistor R10 and the right branch of L2. Thus, since the anode of CR1 is coupled to ground through L1 and the anode of CR2 is coupled to ground through L3, both CR1 and CR2 are forward biased.

Diode CR3 has its anode connected to +V through resistors R3 and R5 while its cathode is grounded through L1 and thus it is reversed biased. Similarly, CR4 is cut off by ground potential coupled to its cathode through R4 and R7 at the same time that its anode is connected to +V through R6 and the left branch of L2. By tracing similar bias connections for CR5 and CR6 it is seen that they are reversed biased by the +V' input. Thus, the rf energy applied to input terminal 34 is coupled by a low impedance straight-through conduction path to output terminal 35 through the forward biased shunting diodes CR1 and CR2. This provides an attenuation to the input signal of substantially 0 db.

When D.C. input voltage V is switched to its negative level while V' remains positive a first level of attenation is imposed on the rf signal by virtue of the fact that CR1 is cut off while CR3 and CR4 are turned on. The rf signal is thus coupled through the pi-pad attenuation network comprising R1, R3 and R4.

When D.C. input V' is also switched to its negative level still higher attenuation is effected since CR1 and CR2 are both cut off and all four termination diodes CR3, CR4, CR5 and CR6 are turned on so that the rf energy input to terminal 34 is coupled through both pi-pad attenuation networks R1, R3, R4 and R2, R8, R9.

Comparing the two stage attenuator network of the present invention as shown in FIG. 4 with the two stage prior art network depicted in FIG. **2*b***, it can be seen that in the low (0 db) attenuation state the network as constructed in accordance with the invention imposes only one half as much insertion loss on the rf signal since only two diodes are coupled in series with the signal as opposed to four diodes in the prior art arrangement.

Further, broadband (in excess of two octaves) operation is achieved in the circuit of the invention by coupling the D.C. switching voltages into the rf circuit through a unique configuration of circuit elements including the high impedance grounded stub members 100, 102, 102' and 120 (FIG. 6). As best shown in FIG. 3, transmission line 32 is made up of a series of conductor sections of differing line length and impedance (line width) characteristics. In particular, the area referred to includes conductor sections 84, 86, 88, 90 and 92, 94, 96, 98. This pattern of transmission line segments is symmetrical about the point where the high impedance stub conductor 100 connects to the rf line. It has been discovered that by proper selection of the impedance and line length characteristics of these transmission line segments adjacent to the stub conductor 100, the admittance of stub conductor 100 can be tuned out over a broad frequency band. This maximizes the voltage transmission coefficient of the transmission line network. Thus, the simple microstrip conductor 100 can be made to provide a degree of broadband isolation similar to or even greater than that secured in the past through use of flying leads. The specific line lengths and impedances for the various transmission line sections and for the stub conductor 100 varies in accordance with the frequency range and passband of interest. One set of conductor parameters which provides excellent results for a frequency band extending from 2 to 8 Gigahertz are as follows:

| | impedance | line length |
|---|---|---|
| Stub conductor 100 | 85 ohms | 74° |
| Transmission line sections 84, 92 | 45 ohms | 14° |
| Transmission line sections 86, 94 | 29 ohms | 37° |
| Transmission line sections 88, 96 | 44 ohms | 57° |
| Transmission line sections 90, 98 | 36 ohms | 18° |

Line length $\theta$ is given in terms of degrees of the center frequency 5 GHz (e.g., 90° = $\lambda/4$). Selection of conductor parameters for other frequency ranges may be determined in accordance with the procedures described in the copending patent application entitled "Printed Broadband RF Bias Circuits And Method of Designing Same," Ser. No. 622,921 filed Oct. 17, 1975 in the name of Allen R. Wolfe.

Looking at FIG. 6, it is seen that a similar arrangement is employed in connection with high impedance stub 102, 102'. The transmission line is configured in a series of six symmetrically arranged conductor segments 104, 106, 108, 110, 112 and 114. A preferred set of conductor parameters for this portion of the circuit (also for the 2–8 GHz band) is as follows:

| | impedance | line length |
|---|---|---|
| Stub conductor 102, 102' | 64 ohms | 70° |
| Transmission line sections 108, 110 | 31 ohms | 52° |
| Transmission line sections 106, 112 | 45 ohms | 37° |
| Transmission line sections 104, 114 | 29 ohms | 13° |

The configuration of transmission line sections associated with high impedance stub 120 is identical to that previously described in connection with stub 100.

The open end stub conductors 40, 42, 44 and 66, 68, 70 (FIG. 3) have also been arranged in a unique combination of alternating resistor and conductor sections to provide high quality A.C. grounded resistive terminations over a broad multi-octave band of frequencies. The stub conductors are a modification of the well known open end quarter-wavelength stub which has been used in the past for narrowband termination purposes. However, instead of a single quarter-wavelength section, the open end stub terminations of the present invention are arranged as a series of alternating resistor-conductor sections of differing parameter values. The resistance values of the resistive elements and the line length and impedances of the conductor segments of each of the open end stub configurations is selected in a manner such that the input impedance $Z_{in}$ for the structure approaches a resistive constant over the multi-octave bandwidth of interest. The parameters may be selected in accordance with the procedures described in the copending application entitled "Printed Broadband A.C. Grounded Microwave Terminations" Ser. No. 622,922 filed Oct. 17, 1975 in the name of Allen R. Wolfe. While the resistance, impedance and line length parameters will vary in accordance with the frequencies of interest, one set of parameters which provides excellent results for the 2–8 Gigahertz frequency range is as follows:

| | impedance | line length |
|---|---|---|
| Resistor 36 – 24 ohms | — | — |
| Resistor 38 – 43 ohms | — | — |
| Conductor segment 40 | 35 ohms | 80° |

-continued

| | impedance | line length |
|---|---|---|
| Conductor segment 42 | 28 ohms | 86° |
| Conductor segment 44 | 28 ohms | 86° |

The above parameter values are also applicable for the three other open end stub elements associated with the preferred embodiment of the present invention (FIG. 6).

The switchable microwave step attenuator of the present invention, as hereinabove described, requires only straightforward printed circuit (e.g., microstrip or stripline) fabrication techniques and eliminates the need for plated over-edges or plated through-holes at critical grounding points. Excellent broadband operation is achieved without the need for flying leads or other expensive circuit elements such that a high performance, low cost, highly reproducible microwave step attenuator has been achieved.

It will be appreciated that various changes in the form and details of the above described preferred embodiment may be effected by persons of ordinary skill without departing from the true spirit and scope of the invention.

I claim:

1. A switchable, microwave step attenuator comprising, in combination:

an insulative substrate having a ground plane conductor on one surface;

a transmission line including attenuation resistance means supported on the surface of said substrate opposite said ground plane surface;

first diode switching means connected in shunt with said attenuation resistance means;

A.C. grounded resistive termination means connected to the said line adjacent to said attenuation resistance means and including second diode switching means; and D.C. bias means connecting said transmission line and said resistive termination means to a source of multi-level, switchable D.C. voltage whereby said first and second diode switching means are selectively switchable between forward and reverse biased states with said first diode switching means being maintained in a state opposite to said second diode switching means;

said A.C. grounded resistive termination means including a pair of open end stub networks connected to said transmission line on either side of said attenuation resistance means, said open end stub networks comprising a plurality of conductive segments connected to each other and to said transmission line by resistive elements, the resistance values of said elements and the line length and impedance values of said conductive segments being such that the impedance value of said network is substantially constant over a band of microwave frequencies at least two octaves in width.

2. The attenuator circuit set forth in claim 1 wherein said second diode switching means includes a diode connected between said transmission line and a resistive element of each of said open end stubs.

3. The attenuator circuit set forth in claim 1 wherein said D.C. bias means includes a pair of high impedance stub conductors connected between said transmission line and said ground plane conductor, said stub conductors being located on either side of said attenuation resistance means and one of said stub conductors being connected to said ground plane conductor through a capacitive element.

4. A switchable, microwave step attenuator comprising, in combination:

an insulative substrate having a ground plane conductor on one surface;

a transmission line including attenuation resistance means supported on a surface of said substrate opposite said ground plane surface;

first diode switching means connected in shunt with said attenuation resistance means;

A.C. grounded resistive termination means connected to said line adjacent to said attenuation resistance means and including second diode switching means, said A.C. grounded resistive termination means including a pair of open end stub networks connected to said transmission line on either side of said attenuation resistance means; and D.C. bias means connecting said transmission line and said resistive termination means to a source of multi-level, switchable D.C. voltage whereby said first and second diode switching means are selectively switchable between forward and reverse biased states with said first diode switching means being maintained in a state opposite to said second diode switching means, said D.C. bias means including a pair of high impedance stub conductors connected between said transmission line and said ground plane conductor, said stub conductors being located on either side of said attenuation resistance means and one of said stub conductors being connected to said ground plane conductor through a capacitive element, and a pair of conductors connected to A.C. ground points on said open end stubs, one of said conductors also being connected to a D.C. ground point and the other of said conductors also being connected to an A.C. ground point on one of said high impedance stub conductors and to said source of multi-level switchable D.C. voltage.

5. A broadband switchable, microwave step attenuator comprising, in combination:

an insulative substrate having a ground plane conductor on one surface;

a transmission line including attenuation resistance means supported on a surface of said substrate opposite said ground plane surface;

diode switching means connected to said transmission line for altering the impedance properties thereof, and isolation means for coupling a D.C. bias potential to said line for controlling the conduction state of said diode switching means, said isolation means including a high impedance stub conductor connected between said line and said ground plane conductor, said transmission line being configured in the area adjacent said stub conductor as a series of segments of differing lengths and impedances, the length and impedance values of said segments being selected to maximize the voltage transmission coefficient of said isolation means over a broadband of microwave frequencies.

6. The attenuator set forth in claim 5 wherein the electrical characteristics of said transmission line in the area of said stub conductor conform to a pattern which is symmetrical about the point of intersection of said stub conductor and said line.

7. A switchable, microwave step attenuator comprising, in combination:

an insulative substrate having a ground plane conductor on one surface;

a transmission line including attenuation resistance means supported on the surface of said substrate opposite said ground plane surface;

diode switching means connected to said transmission line for altering the impedance properties thereof; and a pair of open end stub networks connected to said transmission line on either side of said attenuation resistance means for selectively providing an impedance-matched ground shunt connection under control of said diode switching means, said open end stub networks comprising a plurality of conductive segments connected to each other and to said transmission line by resistive elements, the resistance values of said elements and the line length and impedance values of said conductive segments being such that the impedance value of said network is substantially constant over a broadband of microwave frequencies.

* * * * *